United States Patent [19]

Moran

[11] Patent Number: 4,522,355

[45] Date of Patent: Jun. 11, 1985

[54] APPARATUS FOR SCANNING A ROTATING GYROSCOPE

[75] Inventor: Robert D. Moran, Dahlgren, Va.

[73] Assignee: The United States of America as represented by the Secretary of the Navy, Washington, D.C.

[21] Appl. No.: 499,576

[22] Filed: May 31, 1983

[51] Int. Cl.[3] ..... F41G 7/36; G01C 19/28

[52] U.S. Cl. ..... 244/3.2; 74/5.6 R

[58] Field of Search ..... 244/3.2, 3.16; 74/5.6 D, 5.6 E, 5.6 R

[56] References Cited

U.S. PATENT DOCUMENTS

| | | | |
|---|---|---|---|
| 3,351,303 | 11/1967 | Depew, Jr. et al. | 244/3.16 |
| 3,951,358 | 4/1976 | De Lano et al. | 244/3.2 |
| 4,093,154 | 6/1978 | McLean | 244/3.16 |
| 4,264,907 | 4/1981 | Durand, Jr. et al. | 244/3.16 |
| 4,277,039 | 7/1981 | Blanning et al. | 244/3.16 |

*Primary Examiner*—Charles T. Jordan

*Attorney, Agent, or Firm*—Robert F. Beers; Kenneth E. Walden; John G. Wynn

[57] ABSTRACT

An apparatus comprising, inter alia, gyroscope feedback circuitry which allow scanning the rotor magnet of a gyroscope disposed in an associated guided missile system so as to increase the seeker field thereof is disclosed. A signal from the cage coil of the gyroscope having an amplitude approximating a sine function of the angular position of the spin axis of the rotor magnet portion of the gyroscope with respect to the body axis of the associated guided missile is used to generate a constant amplitude drive signal for driving the precession coil of the gyroscope. Scanning, so as to drive the rotor magnet in a predetermined scan pattern is accomplished by phase shifting the signal from the cage coil as a function of its amplitude and then driving the precession coil with the aforementioned constant amplitude drive signal which is phased-locked to the phase shifted or processed cage coil signal.

5 Claims, 2 Drawing Figures

APPARATUS FOR SCANNING A ROTATING GYROSCOPE

CROSS-REFERENCE TO RELATED APPLICATION

U.S. patent application Ser. No. 493,482, to Moran, entitled "An Electronic Phase Shifter Having A Constant Magnitude Output", filed May 11, 1983, and assigned to the same assignee as the present invention, contains related subject matter.

BACKGROUND OF THE INVENTION

1. Field of the Invention

The present invention relates to an apparatus for scanning a gyroscope, but more particularly the present invention relates to an apparatus for enlarging the scanning field of the gyroscope so as to improve target acquisition of an associated guided missile system.

2. Description of the Prior Art

Heretofore, various apparatuses and techniques have been advanced to improve the utility of gyroscopes in target searching, target acquisition and target tracking especially in guided missile systems. One such technique has been to control the nutation of a gyroscope so as to permit circular or elliptical scan patterns for target seeking purposes. Here, a fixed amplitude excitation at the natural frequency of a spinning mass portion of the gyroscope is introduced to cause nutation in the pitch and yaw axes of the gyroscope. In the absence of a negative rate feedback signal, maximum circular nutation is obtained. Nutation control is obtained by comparing the amplitudes of rate feedback and nutation command signals in a control circuit. The foregoing signals are used to generate torque control signals to cause the aforementioned spinning mass portion of the gyroscope to nutate.

The present invention is contemplated for use with gyroscopes that generate a cage coil signal consisting of an amplitude and phase modulated waveform wherein the frequency of the carrier portion is the same as the inertial spin rate of a rotor magnet, i.e., spinning mass portion of the gyroscope. With the foregoing in mind, the previously mentioned technique does not include scanning by phase shifting the cage coil signal as a function of its amplitude and then driving a precession coil of the gyroscope with a constant amplitude signal which is phase-locked to the phase shifted cage coil signal. Consequently, there is a need in the prior art to configure an apparatus for scanning a rotating gyroscope using the foregoing technique.

As additional background, target seekers using various types of sensors, including radiation types for generating error signals for precessing a particular gyroscope to align its axis with a desired target, have been disclosed in the prior art. Also, at least one technique for generating scanning patterns other than circular and elliptical, e.g., conical, is disclosed.

The prior art and background, as indicated hereinabove, include some advances in gyroscope scanning apparatuses and techniques; however, insofar as can be determined, no prior art apparatus or technique incorporates all of the features and advantages of the present invention.

OBJECTS OF THE INVENTION

Accordingly, an important object of the present invention is to scan a rotating gyroscope by phase shifting the cage coil signal as a function of its amplitude in an improved manner.

A corollary object of the present invention is to drive the precession coil of the gyroscope with a constant amplitude signal which is phase-locked to the phase shifted cage coil signal.

Another object of the present invention is to eliminate transient and other noise problems due to the close proximity of the cage and precession coils.

SUMMARY OF THE INVENTION

In accordance with these and other objects and features of the present invention, an apparatus for scanning a rotating gyroscope is disclosed wherein scanning is accomplished by unique gyroscope feedback circuitry.

The gyroscope feedback circuitry is characterized by having an amplifier/low-pass filter connected to a cage coil portion of the gyroscope to be scanned. A cage coil signal from the cage coil is amplified and filtered, and from one output of the amplifier/low-pass filter fed to the signal input of an electronic phase shifter. The other output of the amplifier/low-pass filter feeds an absolute value circuit. The output of the absolute value circuit drives one input of a differential amplifier. The other input of the differential amplifier is connected to a predetermined reference voltage. The output of the differential amplifier is connected to the control input of the electronic phase shifter. In turn, the output of the electronic phase shifter via a buffer/limiter drives a phase-locked loop. The free running frequency of the phase-locked loop is adjusted to be approximately equal to the spin frequency a rotor magnet portion of the gyroscope so that it will lock-up when driven by the electronic phase shifter. The output of the phase-locked loop, which is 180° out of phase with its input, is filtered and inverted by an inverter/band-pass filter. The output of the inverter/bandpass filter, after being amplified in a precession coil driver, drives the precession coil of the gyroscope.

An advantage of the foregoing embodiment of the present invention is that a large scanning field is possible which is useful in increasing the seeker field of an associated guided missile system. Another, advantage of the foregoing embodiment of the present invention that making the amplitude of the signal for driving the precession coil completely independent of the amplitude of the cage coil signal eliminates instability at certain frequencies caused by capacitive coupling between the cage and precession coils.

BRIEF DESCRIPTION OF THE DRAWINGS

The foregoing and other objects, novel features and advantages of the present invention will be apparent from the following more particular description of a preferred embodiment thereof as illustrated in the accompanying drawings, in which.

DESCRIPTION OF THE PREFERRED EMBODIMENT

Figure 1:
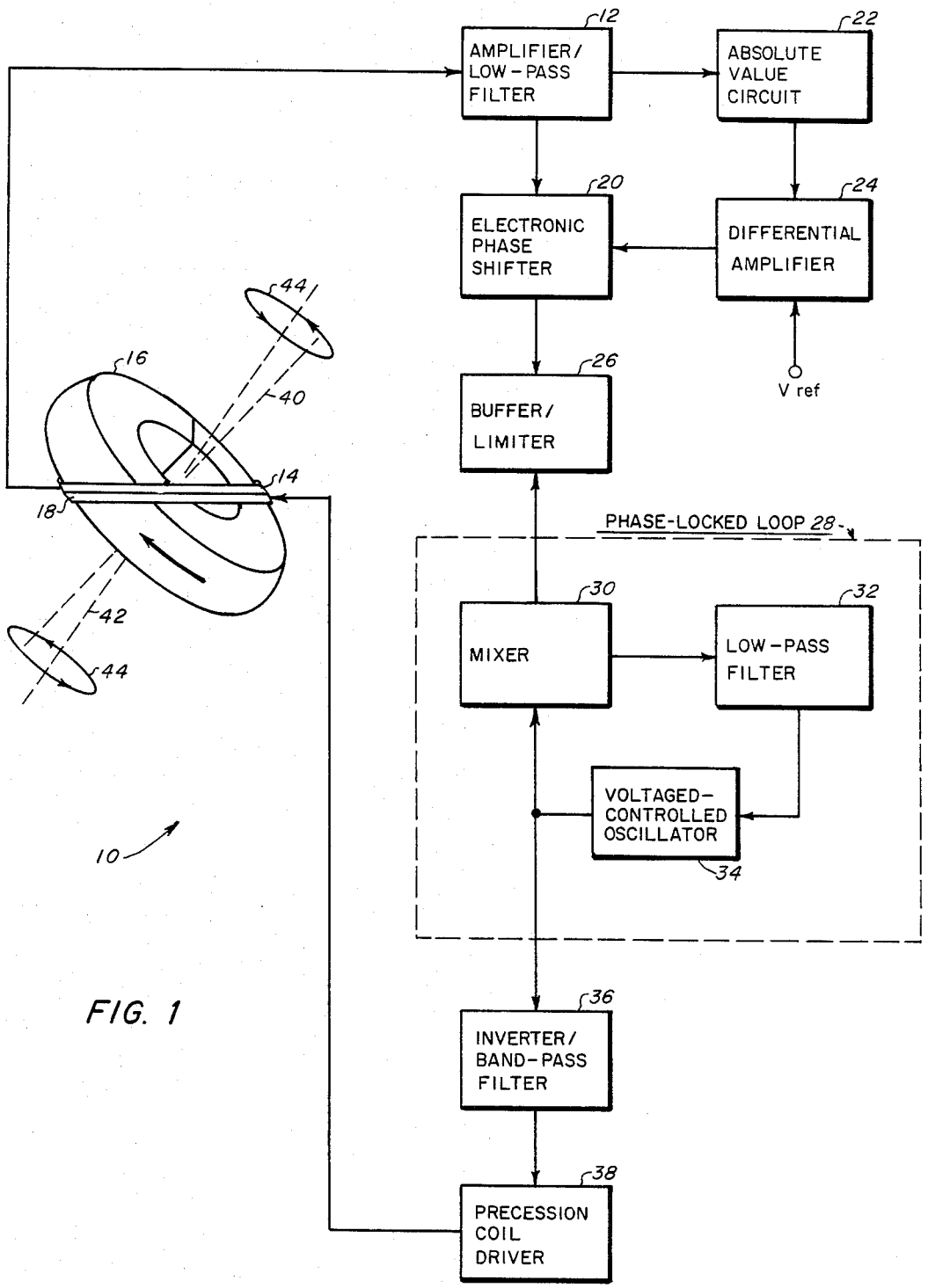
FIG. 1 represents in block diagram form an implementation of an apparatus employing the present invention which is suitable for scanning a rotating gyroscope.

FIG. 1 shows an embodiment of gyroscope feedback circuitry 10 in which the present invention is employed, inter alia, to increase the seeker field of an associated missile system (not shown). Essentially, gyroscope feedback circuitry 10 comprises an amplifier/low-pass filter 12 which is connected at its input to a cage coil 14 disposed about a rotor magnet 16 of the gyroscope to be scanned. Also, as illustrated, a precession coil 18 is wound contiguously to and under the cage coil 14. The amplifier/low-pass filter 12 has two outputs. One output is connected to the signal input of an electronic phase shifter 20 and the other output is connected to an absolute value circuit 22.

For purposes of the present invention, the electronic phase shifter 20 can be any phase shifter capable of substantially 180° phase shift without affecting the magnitude of the signal at its input. Such a phase shifter is disclosed in the aforementioned related U.S. patent application Ser. No. 493,482, to Moran, entitled "An Electronic Phase Shifter Having A Constant Magnitude Output." In addition, the absolute value circuit 22 is configured as a full wave rectifier. More aspects of the foregoing will be discussed hereinafter in the "Statement of the Operation."

Continuing with the block diagram representation of FIG. 1, the output of the absolute value circuit 22 is connected to one input of a differential amplifier 24 with the other input thereof connected to a predetermined reference voltage $V_{ref}$. The output of the differential amplifier 24, which looks like a constant current source, is connected to the other input, i.e., the control input, of the electronic phase shifter 20. The output of the electronic phase shifter 20 via a buffer/limiter 26 drives a phase-locked loop 28. The phase-locked loop 28 includes a mixer 30, a low-pass filter 32 and a voltage-controlled oscillator 34. The phase-locked loop 28 is connected in the conventional manner with one input of the mixer 30 being the input to the phase-locked loop 28. The other input of the mixer 30 is connected to the output of the voltage-controlled oscillator 34, and the output of the mixer 30 is connected to the input of the low-pass filter 32. The junction of the other input of the mixer 30 and the output of the voltage-controlled oscillator 34 is also the output of the phase-locked loop 28. The output of the low-pass filter 32 is connected to the input of the voltage-controlled oscillator 34. This connection completes the loop. The output of the phase-locked loop 28 is connected to an inverter/band-pass filter 36 whose output is connected to the input of a precession coil driver 38. The output of the precession coil driver 38 is connected to the precession coil 18 of the gyroscope to be scanned.

STATEMENT OF THE OPERATION

Figure 2:
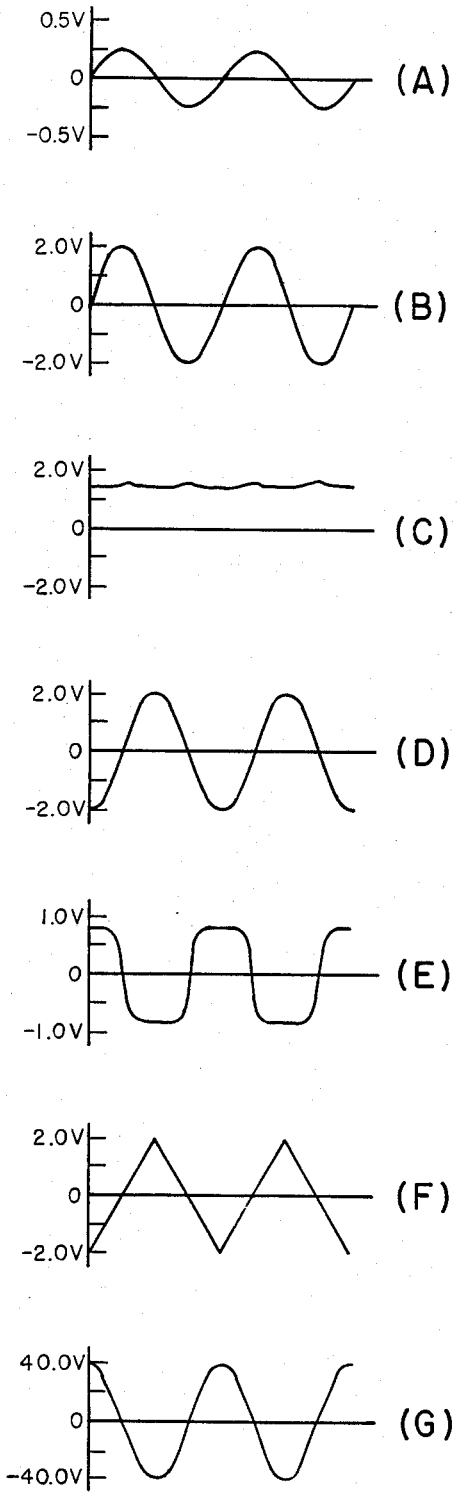
FIG. 2 is a waveform/timing diagram showing the interrelationship of certain waveforms of the apparatus of FIG. 1 during the operation thereof.

Details of the operation, according to the present invention, are explained in conjunction with FIGS. 1 and 2 viewed concurrently.

In operation, the cage coil signal, FIG. 2-A, from the cage coil 14 of the gyroscope to be scanned, is inputted to the amplifier/low-pass filter 12 where it is amplified and filtered so as to sufficiently attenuate the noise present on the cage coil signal without appreciably shifting its phase. The cage coil 14 actually comprises two coils wound about the spin axis 40 of the rotor magnet 16 directly on top of the precession coil 18 and contiguous thereto. Consequently, when the rotor magnet 16 is aligned with the missile body axis 42 of the associated guided missile system (not shown), no voltage is induced, and, accordingly, no cage coil signal is produced. The two coils aforementioned are wound as far apart as is practical, so that when the gyroscope to be scanned gimbals, the voltage induced in each of the coils will be significantly different. Also, the coils are connected in series opposing with the turns of one coil adjusted to cancel cross coupling from the precession coil 18.

To continue, the amplitude of the cage coil signal, FIG. 2-A, is approximately a sine function of the angular position of the spin axis 40 of the rotor magnet 16 with respect to the missile axis 42. When the cage coil signal is phase shifted 90°, the rotor magnet 16, and, accordingly, the gyroscope to be scanned will be precessed in a circle as depicted by a scan pattern 44. Phase shifting the cage coil signal less than 90° will cause the rotor magnet 16 to spiral inwards towards the missile body axis 42. This action corresponds to a decrease in the amplitude of the cage coil signal. On the other hand, phase shifting the cage coil signal more than 90° will cause the rotor magnet 16 to spiral outward. This action corresponds to an increase in the amplitude of the cage coil signal.

Phase shifting is accomplished in the electronic phase shifter 20 by driving its signal input with the conditioned cage coil signal, FIG. 2-B, and its control input with a control signal, FIG. 2-C, that is directly proportional to the amplitude of the cage coil signal, FIG. 2-A. The control signal, FIG. 2-C, corresponds to a current generated by the differential amplifier 24 in response to the difference between the full wave rectified replica of the cage coil signal at the output of the absolute value circuit 22 and the predetermined reference voltage $V_{ref}$. The predetermined reference voltage $V_{ref}$ is selected to set the scan diameter of the scan pattern 44. The phase shifted cage coil signal, FIG. 2-D, (shown shifted by 90°) drives the buffer/limiter 26 which operates as a high impedance buffer as well as as a limiter so as to prevent the input of the phase-locked loop from being over driven by the varying amplitude of the cage coil signal, FIG. 2-A. The output of the buffer/limiter 26 is illustrated in FIG. 2-E. This signal drives the phase-locked loop 28 which is used to isolate the precession coil drive signal, FIG. 2-G, from the aforementioned cage coil signal, FIG. 2-A. The free running frequency of the phase-locked loop 28 generated by its voltage-controlled oscillator 34 is adjusted to be approximately equal to the spin frequency of the rotor magnet 16 so that the loop will lock-up upon the application of the signal of FIG. 2-E.

Still referring to FIGS. 1 and 2 as viewed concurrently, the output of the phase-locked loop 28 is a triangular waveform, FIG. 2-F, which is 180° out of phase with its input signal, FIG. 2-E, thereof. Accordingly, the triangular waveform is inverted and filtered slightly in inverter/bandpass filter 36 to produce the precession coil drive signal, shown in FIG. 2-G, after power amplification in the precession coil driver 38. The output of the precession coil driver 38 drives the precession coil 18.

Thus, scanning is accomplished by phase shifting the cage coil signal, FIG. 2-A, as a function of its amplitude and then driving the precession coil 18 with a constant amplitude signal, FIG. 2-G, phase-locked to the phase shifted or processed cage coil signal, FIG. 2-D.

To those skilled in the art, many modifications and variations of the present invention are possible in light of the above teachings. It is therefore to be understood that the present invention can be practiced otherwise than as specifically described herein and still be within the spirit and scope of the appended claims.

What is claimed is:

1. An improved apparatus for scanning a rotating gyroscope of the type having a rotor magnet, a cage coil disposed about said rotor magnet and a precession coil wound contiguous to and under said coil, wherein the improvement comprises:

first operatively connected to said cage coil for phase shifting a cage coil derived signal as a function of its amplitude;

a phase-locked loop operatively connected at its input to the output of said first means and having a free running frequency approximately equal to the spin frequency of said rotor magnet so that said phase-locked loop locks-up upon the application of the phase shifted cage coil derived signal from said first means, and so that said phase-locked loop outputs a waveform that is 180° out of phase with the phase shifted cage coil derived signal at its input; and second means operatively connected at its input to the output of said phase-locked loop and at its output to said precession coil for driving said precession coil with a constant amplitude signal phase-locked to the phase shifted cage coil derived signal so as to drive said rotor magnet about its spin axis in a predetemined scan pattern about the missile body axis of an associated missile system.

2. The improved apparatus of claim 1 wherein said first means comprises:

an amplifier/low-pass filter connected at its input to said cage coil for amplifying and filtering the cage coil derived signal so as to sufficiently attenuate the noise present thereon without appreciably shifting the phase thereof, said amplifier/low-pass filter having two outputs;

an absolute value circuit connected at its input to one of the outputs of said amplifier/low-pass filter for deriving an output signal level indicative of the absolute value of the cage coil derived signal wherein the amplitude of the cage coil derived signal is approximately a sine function of the angular position of the spin axis of said rotor magnet with respect to the missile body axis of the associated missile system;

a differential amplifier connected at one input to the output of said absolute value circuit and at its other input to a predetermined reference voltage, said differential amplifier generating a control signal at its output in response to the difference between the output signal level indicative of the absolute value of the cage coil derived signal and the predetermined reference voltage, the predetermined reference voltage being selected so as to set a desired scan diameter of the scan pattern; and an electronic phase shifter operatively connected at a signal input to the other output of said amplifier/-low-pass filter and operatively connected at a control input to the output of said differential amplifier, the control signal at the control input being directly proportional to the amplitude of the cage coil derived signal, said electronic phase shifter being capable of phase shifting the signal at its input 180° without affecting the magnitude thereof.

3. The improved apparatus of claim 2 wherein said first means further comprises, a buffer/limiter operatively connected at its input to the output of said electronic phase shifter for providing a high impedance to the output of the electronic phase shifter and for limiting the varying amplitude of the phase shifted cage coil derived signal so as not to over drive the input of said phase-locked loop.

4. The improved apparatus of claim 3 wherein said phase-locked loop comprises:

a mixer having one input operatively connected to the output of said buffer/limiter;

a low-pass filter having its input operatively connected to the output of said mixer; and a voltage-controlled oscillator having its input connected to the output of said low-pass filter and its output connected to the other input of said mixer, the junction formed being the output of said phase-locked loop, the free running frequency of said phase-locked loop being set by said voltage-controlled oscillator.

5. The improved apparatus of claim 4 wherein said second means comprises:

an inverter/band-pass filter operatively connected at its input to the output of said phase-locked loop for inverting the waveform thereat so that it is in phase with the phase shifted cage coil derived signal and for filtering the waveform, which is triangular, so as to replicate a sine wave at its output; and a precession coil driver operatively connected at its input to the output of said inverter/band-pass filter and at its output to said precession coil.

* * * * *